United States Patent [19]

Farrar et al.

[11] Patent Number: 5,033,795

[45] Date of Patent: Jul. 23, 1991

[54] METHOD OF MINING A MINERAL DEPOSIT SEAM

[75] Inventors: Richard B. Farrar, Bethel Park; William D. Mayercheck, New Stanton; George R. Bockosh, Library, all of Pa.

[73] Assignee: The United States of America as represented by the Secretary of the Interior, Washington, D.C.

[21] Appl. No.: 434,062

[22] Filed: Nov. 9, 1989

[51] Int. Cl.[5] ..... E21C 41/04

[52] U.S. Cl. ..... 299/18; 299/35

[58] Field of Search ..... 299/18, 10, 33, 35, 299/63, 65, 66, 82, 83, 84; 125/21

[56] References Cited

U.S. PATENT DOCUMENTS

| | | | |
|---|---|---|---|
| 753,092 | 2/1904 | Neukirch | 299/35 |
| 3,620,573 | 11/1971 | Oxford | 299/35 |
| 4,059,309 | 11/1977 | Cleary | 299/66 X |
| 4,232,904 | 11/1980 | Hurd | 299/18 |

FOREIGN PATENT DOCUMENTS

| | | | |
|---|---|---|---|
| 507198 | 5/1952 | Belgium | 299/35 |

*Primary Examiner*—Stephen J. Novosad
*Assistant Examiner*—David J. Bagnell
*Attorney, Agent, or Firm*—E. Philip Koltos

[57] ABSTRACT

A method of mining seams is provided for a mineral deposit situated beneath a substantial overburden, such as would be found in a mountaintop ridge formation previously mined by contour mining operations so that roadways exist at the sides of the ridge formation. A continuous loop chain cutting device which extends across the width of the ridge is positioned near the front end of the seam. Vehicles supporting the ends of the device move along the roadways so that the cutting device cuts a thin slot in the seam which remove the mineral deposits yet allowing the remaining mineral deposit and overburden to subside gradually after the cutting blade has passed a given point. At a desired point along the length of the ridge, the vehicles direction and the cutting device continues to cut a thin slot in the seam in the opposite direction. This back and forth movement is continued until the mineral deposit is substantially removed from the ridge.

11 Claims, 3 Drawing Sheets

METHOD OF MINING A MINERAL DEPOSIT SEAM

FIELD OF THE INVENTION

The invention relates in general to a method of mining a seam of a mineral deposit such as coal, and more particularly to a method of mining coal using a continuous loop chain or cable drawn cutting device directed through the seam to remove the coal while causing minimal disruption to the overburden above the mineral deposit seam.

BACKGROUND OF THE INVENTION

At present, a very large part of the coal reserves in the United States is found in seams which are very difficult to mine because of physical constraints and economical considerations. Approximately one trillion tons of coal are found in seams 14–28 inches thick; however, less than five percent of all U.S. coal production comes from these resources. In the coal rich region of Appalachia, approximately forty percent of the minable coal reserves exist in hard to get 28–42 inch thick seams. Still other mineral deposits in seams greater than 42 inches in thickness also remain untapped because of their inaccessibility.

In the past, these mineral reserves were only partially exploited by methods such as contour mining and highwall auger mining along the mountainous ridges where the coal seam outcropped and was easy to reach. This type of contour strip mining removed only a small fraction of the total coal reserve, and further scarred the landscape with highwalls that stand today as steep, unstable and unsightly hillside cuts. By 1977, it was determined that strip mining had left about 25,000 miles of unreclaimed highwalls in various regions of the United States. These previous mining efforts have thus not only seriously impacted the environment, but have left the huge coal reserve in relatively thin seams largely untapped. A need therefore exists for improved and cost effective mining technology to address the problem of recovering seams of mineral deposits, particularly in mountaintop ridges which have previously been contour-strip mined.

In the patent arts, various machines and methods have been disclosed for mining coal along the length of an elongated coal face. In U.S. Pat. No. 4,225,186 (Stratton) there is disclosed an apparatus for mining the coal seams in which a cutting tool extends from a service vehicle and cuts a deep slot about 24 feet in length in one half of the earth formation mine. This cutting tool is adjustable in terms of elevation, sweep and pitch and is designed for one-way movement through the coal seam. The other half of the earth formation mine is completed by a second sweep of this vehicle. This system requires a complex elevator assembly needed to adjust the cutting tool and cut deep slots in the coal seam, and can potentially disturb the overburden or cause massive overburden fall. The length of the cutting tool is limited to a maximum of about 24 feet because of the cantilever reaction forces on the bar and the base machine, and therefore this system is limited to areas where access to the seam is provided every 48 feet. There thus still exists a need for a system for extracting a mineral seam from a large overburden (such as mountain ridges over 1,000 feet in width) in a manner which eliminates the need for roof supports yet which does not induce massive fall of the overburden.

Other systems for mining coal are also known, such as those disclosed in U.S. Pat. Nos. 4,118,072 (Kelley et al), 1,821,439 (Levin), 4,445,723 (McQuade), and 4,278,293 (Paurat et al), but these are not directed specifically to the mining of coal deposits in relatively thin seam formations. Further, these previous systems are commonly subject to cave effects and roof control problems which can trap or damage the machines and severely disrupt mining efforts. What is desired therefore, is a simple, cost effective, efficient method for mining coal in seams of varying thickness which can be accomplished safely, which does not require miners underground, which eliminates the need for roof supports, and which can be carried out without the risk of undesirable massive falls of overburden.

SUMMARY OF THE INVENTION

In accordance with the present invention, a method is provided for mining a seam of a mineral deposit such as coal which is situated beneath an overburden in an earth formation to which access has been provided by roadways along the sides of the formation comprising the steps of:

a) positioning at a point near the lower end of the mineral deposit seam a continuous loop chain or cable drawn cutting device which extends across the width of the ridge formation and is supported at each end by a vehicle capable of traveling along the roadways at the sides of the formation;

b) directing the vehicles supporting the cutting device to move along the roadways so that the cutting device engaging the mineral deposit seam cuts a thin slot in the seam in the direction of the movement of the vehicles and the mineral deposits from the seam are removed to the sides of the formation by the action of the cutting device, the cutting device being operated so that the mineral deposit and the overburden above the thin slot created by the cutting device subside gradually and close the slot after the cutting device has passed a given location;

c) reversing the direction of the vehicles after a desired length of the formation is traversed so as to continue the operation of the cutting device in the opposite direction until the cutting device reaches a point near the initial engagement of the formation;

d) continuing the operation of the vehicles in such a back and forth manner until the mineral deposit is substantially removed from the formation and only the overburden remains; and e) collecting the removed mineral deposit from the roadways at the sides of the formation.

The present method is designed to recover coal from seams at the base of mountaintop ridges, but can be used as well in other situations such as an underground mining setting where there is an earth formation having roadways along the side which can be traversed by vehicles supporting a cutting device. In addition, this method can be used in other areas where there is a thin seam of coal under an overburden in an area, such as a flat tract of land, to which access has not been previously provided, by first excavating two roughly parallel trenches along the sides of the desired strip of land, and proceeding in the manner described above. The present invention provides for safe and cost effective removal of coal or other mineral deposits from seams located under a substantial overburden which can be accomplished without disrupting the overburden, without the need for roof supports, and with a greatly reduced probability of causing massive overburden fall. By use of the present invention, a much higher percentage of recovery of coal which remains in relatively thin seams at various above ground and below ground locations can now be accomplished.

BRIEF DESCRIPTION OF THE DRAWING FIGURES

DETAILED DESCRIPTION OF THE PREFERRED EMBODIMENTS

The present invention is particularly designed for use in recovering minerals from a seam underlying a mountaintop ridge formation which is accessible from existing highwall benches or newly created benches which expose the seam, as would be found in ridges previously exploited by contour strip or surface mining methods. However, as will be explained below, the present invention can be employed to remove coal from seams located under a relatively thick overburden at a number of locations other than mountain top ridges. It is only necessary that access to a particular formation of land having the desired seam of mineral be provided such that vehicles capable of supporting a cutting device can operate along the sides of the formation.

Figure 1:
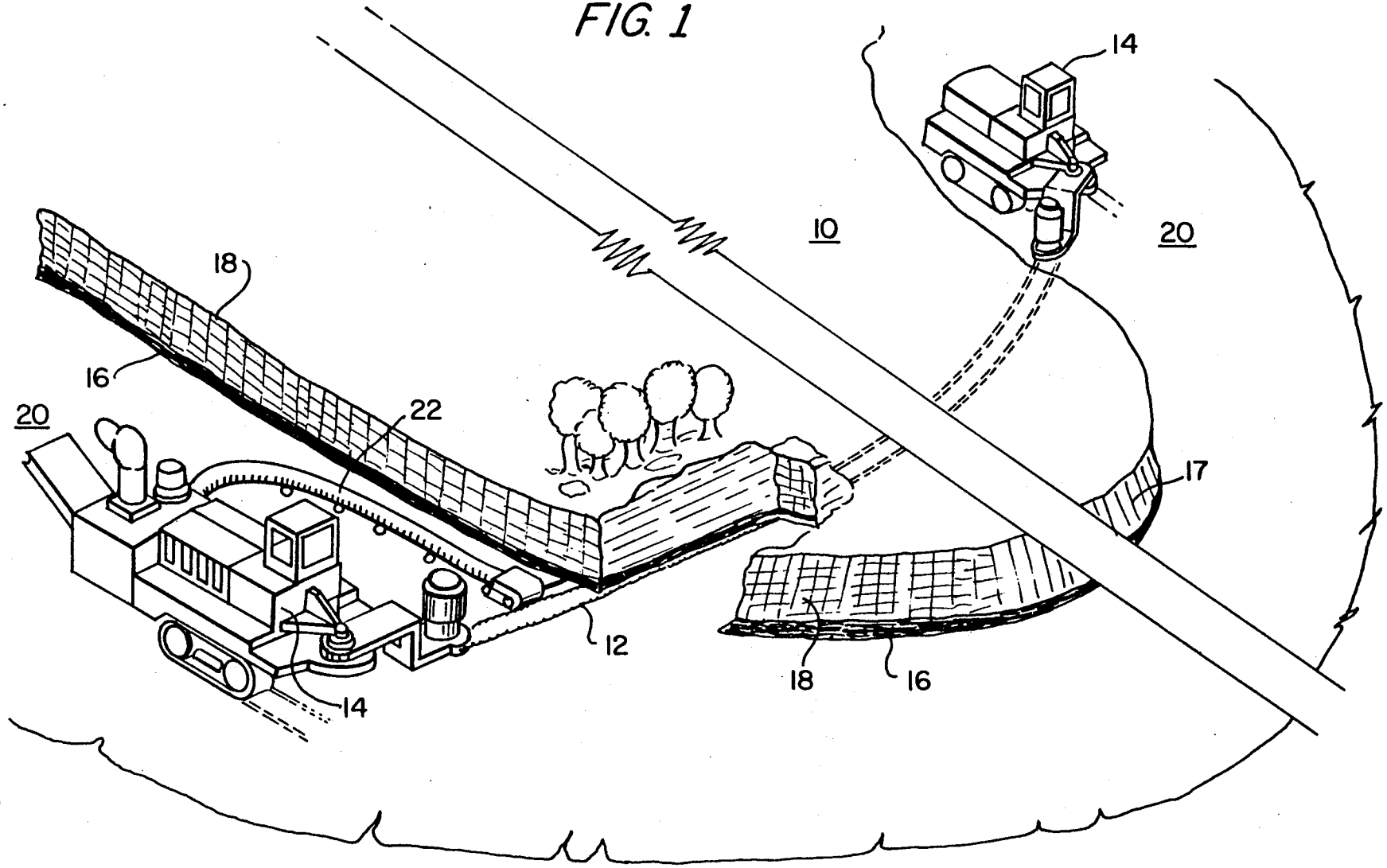
FIG. 1 is a perspective view of a mining operation of a thin seam of coal in accordance with the method of the present invention.

In accordance with the present invention, a method of mining a seam of a mineral deposit situated beneath an overburden in a ridge or other earth formation where access has been provided by roadways at the sides of the formation comprises first positioning a cutting device supported at each end by a vehicle in front of the seam and then operating the vehicles so that the cutting device cuts a thin slot in the seam, and removes the minerals to the side roadways where they can be recovered. A preferred apparatus for carrying out the present invention can be observed in FIG. 1. In this apparatus, a continuous loop chain or cable drawn cutting device 12 is drawn between two service vehicles 14 and positioned at a point approximately near the lower front end 17 of the mineral deposit seam 16 in ridge formation 10. The cutting device 12 should be at such a length so as to extend across the greatest width of the formation 10 which will be mined using the present method. It is preferred that the cutting device be one which can cut into the seam at either direction that the vehicles are traveling without the need for inverting the saw when the vehicles go in an opposite direction.

When a cutting operation is started, the chain saw is operated and the vehicles start down the roadways 20 so that the cutting device 12 engages the mineral deposit seam 16 at the front end 17 of the formation. As the vehicles move down the roadways, the device cuts a thin slot in the seam in the direction of the movement of the vehicles. In order to minimize disturbance to the overburden 18 and reduce the chance of overburden fall, it is desired that the thin slot be cut by chain cutting device 12 at a very deliberate pace. The vehicles supporting the cutting device thus should traverse the roadways slowly, ideally at speeds of about 2 inches/-minute which is preferred for a 500 foot long face and a 4 inch high slot. In this way, the mineral deposit and the overburden above the thin slot created by the cutting device will subside gradually and close the slot after the cutting device has passed through a given area. It is desired that the slot itself be a relatively thin cut, and should be no greater than about 3 to 6 inches in thickness, and preferably about 4–5 inches. Again, the thin size of the cut will act to cause minimal disturbance to the overburden.

It is contemplated that the thin slot cutting procedure will continue along the length of the ridge formation for a desired distance, usually the entire length of the coal seam. After the desired length of the ridge has been traversed, and the vehicles reach a point at which the coal seam ends, the direction of vehicles 14 is reversed and the coal cutting operation continues in the operation direction. Employing a continuous loop cutting device as observed in FIG. 1, no inversion of the cutting device is necessary and the operation can proceed in the opposite direction without the need to change or invert the cutting blade. The vehicles will then proceed back along the roadway in the opposite direction to the initial cutting step until the cutting device reaches approximately the point where the initial engagement of the ridge had been undertaken. After this point, the vehicles will operate again in the original direction, and will continue cutting until the desired length is reached.

As the cutting device passes through the coal seam and cuts a thin slot in the mineral deposit layer, the remaining mineral deposit and overburden above the thin slot subside gradually and close the slot after the cutting device has passed a given location. Thus, the operation can continue back and forth in this manner with the cutting blade set at a desired height which does not need to change throughout the entire cutting procedure. It is thus intended that the mining operation proceed with the cutting blade being directed back and forth through the ridge formation until a point is reached wherein the mineral deposit has been substantially removed to the side roadways and only the overburden will remain.

In the mining method as described above, the mineral deposits from the seam are removed to the sides of the ridge by the cutting and conveying action of the cutting device and will accumulate in the roadways 20 on the side of ridge formation 10. Coal recovery can thus be accomplished by collecting these removed minerals from the roadways. It is contemplated that a vacuum system will be used to collect the minerals which have accumulated in the roadways. However, a number of alternative mechanical embodiments well known in the art are also possible. The collection of the removed minerals is preferably accomplished by means of a vacuum system 22 connected to the service vehicles 14 which support and move the cutting device 12, as observed in FIG. 1.

In the operation of the present invention, it is not absolutely necessary that the two roadways be at the same level. At certain locations, the roadways are not on the same level, and the mineral deposit seam can be pitched. In such a case, the blade or cutting device stretched between the two vehicles will be pitched at the approximate angle of the coal seam, and the cutting procedure will then be carried out in approximately the same manner as described above. In this case, substantial amounts of the minerals removed from the pitched seam may accumulate on the lower of the two roadways.

Ideally, in the present invention, the cutting device used in the mining operation is a continuous loop chain cutting device such as a coal cutting chain saw which operates in the continuous loop so as to allow cutting in the forward direction when the vehicles are moving down the ridge as well as cutting in the reverse direction when the vehicles move back in the opposite direction. This bidirectional cutting can occur without changing the saw blades when the direction of the vehicles is reversed. However, if so desired, it is possible to employ a cutting device wherein the blade can be inverted when the cutting has been completed in a given direction, typically after the vehicles have emerged at one end of the ridge.

Still other alternate embodiments of the tension cutting and conveying system can also be employed in accordance with the method of the present invention. For example, a water jet cutting device can be employed which is applicable for cutting the thin slices of coal from the coal seam in the slot as desired in the present invention. The water jet cutting embodiment is particularly useful in the invention because it also allows for cutting thin slices of coal from the seam, and as in the main embodiment, does so without the need for roof supports. In addition, a water jet cutting device will be particularly suitable for when mining of pitched coal seams is carried out as described above. Another alternate procedure employes a shearer-type of cutting device which is driven by a capstan drive arrangement. In such an arrangement, power is applied by a cable system operated remotely by equipment located on the open roadways adjacent to the coal seam being mined.

Figure 2:
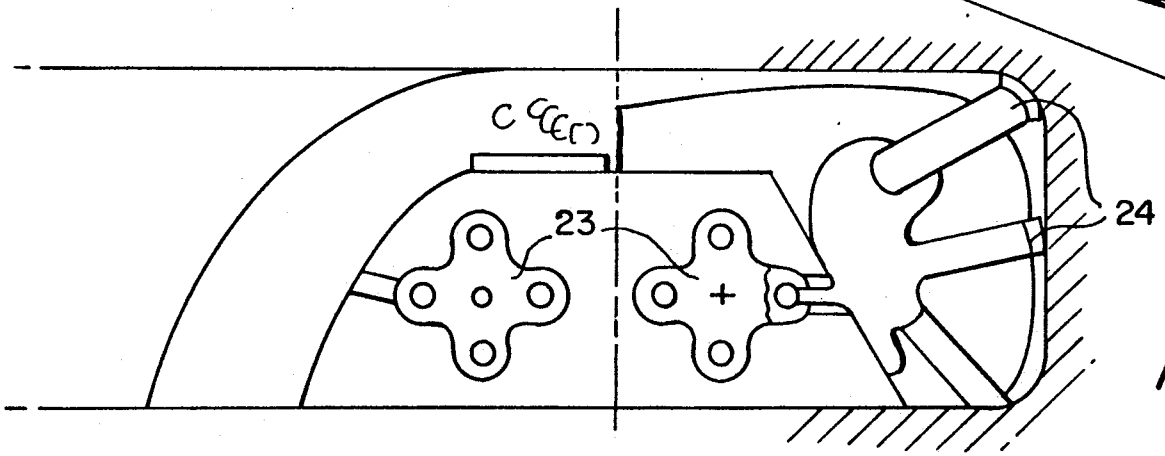
FIG. 2 is a side view of a cutting blade with paddle elements which can be used in the present invention.

In another embodiment of the present invention, a variation in the chain saw cutter system is employed wherein the return loop of the chain saw is specifically used as a conveyor to enhance the coal conveying capability of the chain saw. A device incorporating this concept can be observed in FIG. 2. In this embodiment, the chain used in the cutting device is fitted not only with cutting bits 2 but with plow-like paddles 24 that can cast the cut coal over the top of the cutting chain guide blade to the back side of the blade where it is picked up by the return chain saw loop and carried out of the mine area. The return loop of the chain saw can be converted to a conveyor by inverting the chain as it exits the mine on the cutting pass and just prior to reentering the mine for the return pass. The inverting equipment can be located on the surface vehicle on the roadway as part of the chain drive mechanism. By inverting the cutting chain on the return pass, the geometry is changed to that favoring conveying of the coal. The chain saw guide preferably has four guide channels, two of which are used for the chain saw loop when cutting in one direction. For reversing the chain saw cutting direction in this embodiment, the chain is threaded in the other two channels in the guide blade. The cutting bits and paddle elements used in this embodiment enhance the removal of the mined minerals from the seam.

Further embodiments can be employed to improve the coal recovery using the method of the present invention, such as use of a passive protective shield to cover the cutting equipment and protect it from stray overburden that might enter the cutting engagement area during subsidence and caving as the coal seam is extracted. Although not required, it is also possible to establish a roof support system near the point of engagement of the cutting device with the mineral deposit seam so that further support of the roof against a massive fall of overburden will be accomplished. It is further possible to make use of backfilling of the immediate excavated area by pneumatic stowing of mine waste. In such a system, the stowed mine waste is used to add additional support to the overburden. In general, however, the thin slot method of the present invention as described above will accomplish removal of a coal seam situated under an overburden without the need for any roof supports whatsoever.

Although the method of the present invention is contemplated particularly to apply to cases wherein the ridge formation mined is a mountaintop which has been previously strip mined, it is quite possible to apply the method of the present invention to any land formation wherein a seam of a mineral deposit is situated under an overburden. For instance, a formation in an underground mine setting wherein a seam of a mineral under a strip of overburden has been isolated such that there are roadways or trenches along the sides of the seam can be mined using the methods of the present invention as described above. In these embodiments, the vehicles will operate from entries normally serving the long wall in the underground long wall mining situation, and the operation would be in a manner identical to the mountaintop mining system described above. Again, this embodiment would not need to employ a roof support system, and it allows mining of relatively thin seams in cases where a regular long wall installation could not be used because of economic constraints or physical size constraints. Similarly, the system of the present invention can also be used in an underground room and pillar mining setting. In this embodiment, the method would be used to remove pillars in the retreat or secondary mining operation in the room and pillar mining method. Existing entries would be used as the access openings and would serve as the highwall roadways in the mountaintop mining system. The cutting system could span a number of pillars or could span just a single pillar if desired. In this way, partial pillar extraction could be effected, or total pillar extraction could be accomplished where necessary.

Figure 3:
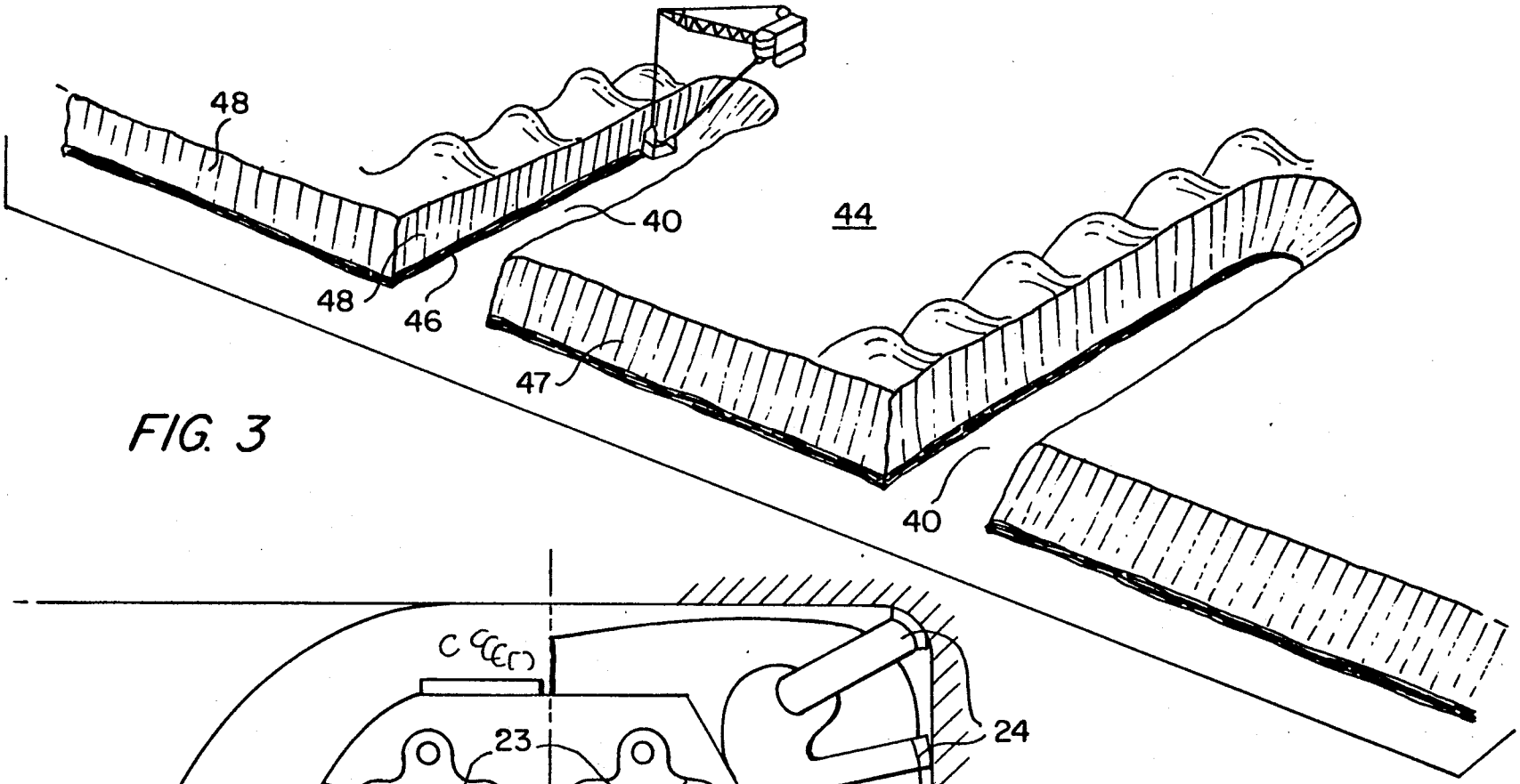
FIG. 3 is a perspective view of a flat land area which has been excavated so as to be suitable for mining in accordance with an alternate embodiment of the present invention.

The extraction of coal as provided in the present method can be accomplished in an area of flat land as well, again wherein the seam of a mineral deposit is situated under a substantial overburden. It is only necessary in these cases that excavation of at least two roughly parallel elongate trenches in the land be made so that a central strip of land is created between the two trenches having an exposed mineral deposit seam lying underneath the remaining overburden. In such a flat land area, such as observed in FIG. 3, the excavation of the trenches 40 is carried out in any suitable conventional manner, such as by diesel dragline machine 42 which eliminates the overburden 48 and cuts down to the mineral deposit seam 46. In such a case, the two service vehicles which support the continuous loop cutting device will be positioned at the front end 47 of the strip of land 44, with one service vehicle in each trench 40, and the thin slot cutting procedure will take place as described above for the mountaintop ridge formation.

Figure 4:
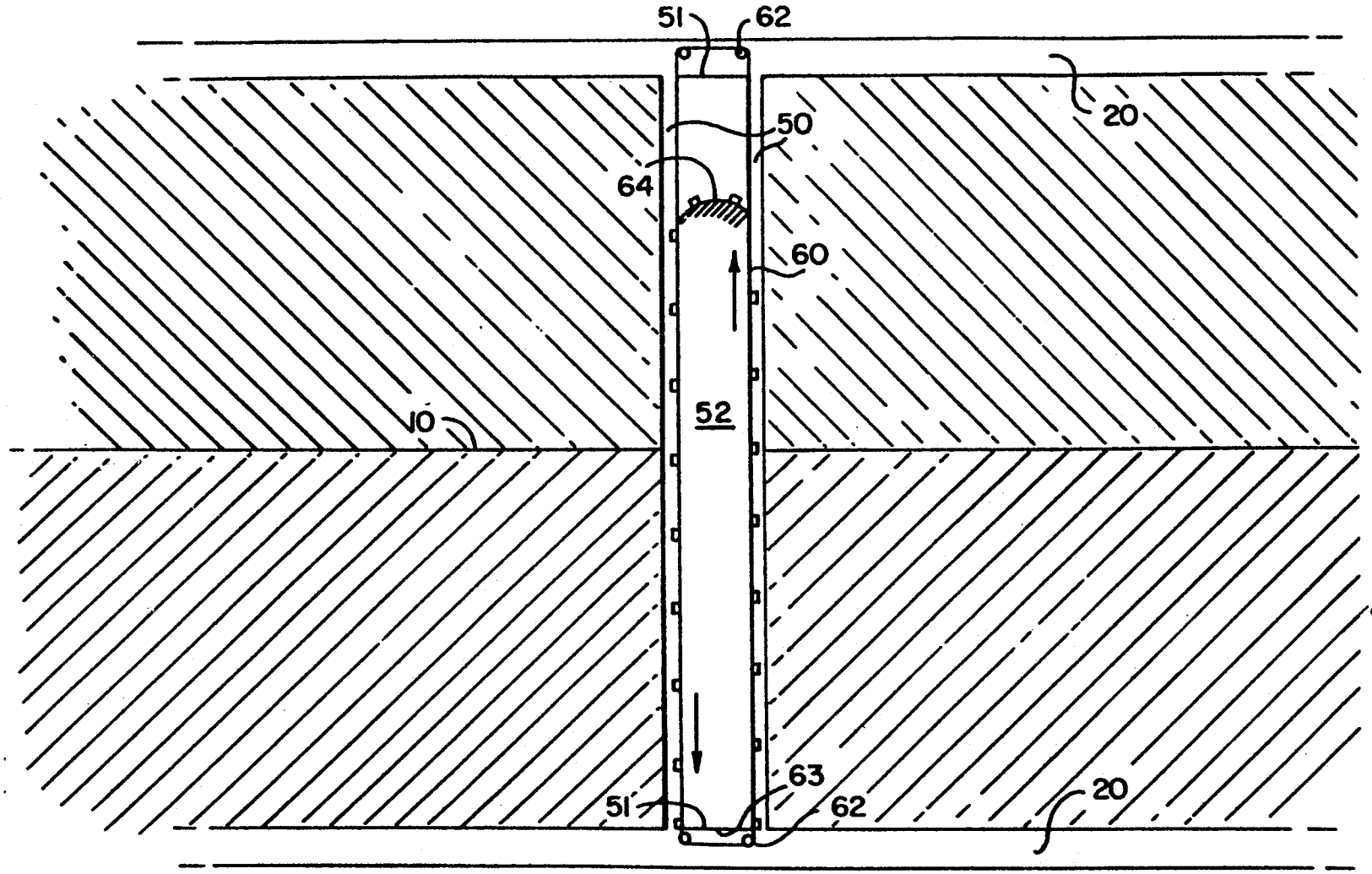
FIG. 4 is a partially cutaway schematic view of a cross-ridge method of mining in accordance with an alternate embodiment of the present invention.

A variation of the above-described methods is possible so that across-the-ridge mining for mountaintops can be accomplished to extract coal from particular sections of the ridge. In such a method, access holes 50 can be excavated into the ridge extending from one of the roadways 20 previously existing along the side of ridge 10, as observed in FIG. 4. These two access holes 50 are bored such that a central ridge portion 52 containing overburden and exposed mineral deposit seam is created. Once this central ridge portion is created, a continuous loop chain or cable drawn cutting device is drawn around the central ridge portion at the level of the seam using access holes 50 and the portion 51 of the roadways 20 between the access holes. Preferably, the cutting device 60 will be connected to a drawworks 62 or other cable driving device at each end of the central ridge portion 52. The drawworks apparatus 62 will be able to direct the cutting device 60 to cut a thin slot in the mineral seam in the direction of the take-up of the drawworks or cable drive means so that mining occurs in a cross-ridge direction sideways into the mountain, from one roadway to another. This can be observed in FIG. 4 wherein the cutting device impinges the ridge at cutting face 64, and the cutting will proceed until the opposite end 63 of the ridge is reached. When the opposite side of the ridge portion is reached, the direction of the cutting action is reversed by reversing the take-up of the drawworks, and cutting occurs in the opposite direction until a point near the initial engagement of the central ridge portion is reached.

The mining process will continue in this back and forth manner until the desired seam in the central ridge portion has been substantially mined. During this cross-ridge process, the coal is initially removed into the access holes, and will subsequently be directed into the roadways by the action of the cutting device. The coal can then be recovered by collecting the removed minerals from the roadways or from the access holes using any conventional collection means as indicated previously. The thin-slot cutting method of the present invention will again ensure that gradual removal of the seam of coal or other mineral can occur without the danger of a massive fall of overburden, yet also without requiring roof supports or men working underground. This cross-ridge system will be particularly useful in ridges where there might be specific areas having a significant seam of a mineral deposit which does not extend the entire length of the ridge.

The above-identified embodiments of the present invention constitute a substantial improvement in the mining of seams of coal underneath a substantial overburden such that this coal can now be extracted at very low cost and with a very high percentage of recovery. The use of the present invention will be particularly advantageous in coal seams of from about 14 inches to 42 inches wherein normal surface methods and various underground methods cannot be employed either because men and equipment cannot fit into these seams or that the mining costs are just too high. The mining systems of the present invention are extremely advantageous in that they can be operated remotely from the outside roadways and will thus employ no men underground. In most of the cases described above, no roof support or ground control system is required. This will eliminate perhaps the most costly part of previously used long wall type mining systems. Elimination of the need for roof support systems opens up great opportunities for mining coal at very low cost and is thus extremely desirable. The present system is also extremely advantageous environmentally in that it does not require massive removal of overburden with the resulting scarring of the landscape, and it also eliminates the need for reclamation and attendant costs. As a further advantage, it eliminates the potential for acid mine drainage which was quite often the case with auger holes produced in the previously used auger highwall mining system. The present invention will encourage remining of abandoned highwall mines which have been left without full recovery of the coal existing therein. Using the techniques described above, a far greater utilization of the coal resources of this country will now be possible in a cost-effective manner.

What is claimed is:

1. A method of mining a mineral deposit seam situated beneath an overburden in an earth formation to which access has been provided such that roadways exist at the sides of the formation, said method comprising the steps of:

a) positioning at a point near the lower end of the mineral deposit seam a continuous loop chain or cable drawn cutting device which extends across the width of the formation and is supported at each of its ends by a vehicle designed to travel along the roadways at the sides of the formation;

b) causing the vehicles supporting the cutting device to move along the roadways in a first direction so that the cutting device engaging the mineral deposit seam cuts a thin slot of approximately 3 to 6 inches in thickness in the seam in the direction of the movement of the vehicles and mineral deposits from the seam are removed to the sides of the formation by the action of the cutting device, the cutting device being operated so that the mineral deposits and the overburden above the thin slot created by the cutting device subside gradually and close the slot after the cutting device has passed a given location;

c) reversing the direction of the vehicles after a desired length of the formation has been traversed so as to continue the operation of the cutting device in the opposite direction until the cutting device reaches a point near the initial engagement of the cutting device with the formation;

d) continuing the operating of the vehicles in a back and forth manner until the mineral deposit seam is substantially removed from the formation and only the overburden remains; and e) collecting the removed mineral deposits.

2. A method of mining according to claim 1 wherein the mineral deposit mined is coal.

3. A method of mining according to claim 1 wherein the mineral deposit seam ranges from about 14 to about 42 inches in thickness.

4. A method of mining according to claim 1 further comprising using a vacuum system to collect the removed minerals.

5. A method of mining according to claim 4 further comprising connecting the vacuum system to the vehicles supporting the cutting device.

6. A method of mining according to claim 1 wherein removal of the deposits using said cutting device is effected by cutting said slot using a cutting device comprising a continuous loop coal cutting chain saw including paddle elements for assisting in removing the deposits.

7. A method of mining according to claim 1 further comprising the step of backfilling the excavated area by pneumatic stowing of mine waste to provide further support against fall of overburden.

8. A method of mining a mineral deposit seam located under an overburden in an area of flat land, said method comprising the steps of:

a) excavating at least two roughly parallel elongate trenches in the land so that a strip of land is created between the two trenches which has an exposed mineral deposit seam lying underneath the remaining overburden;

b) positioning at a point near the lower end of the mineral deposit seam a continuous loop chain or cable drawn cutting device which extends across the width of the land strip and which is supported at eat of its ends by a vehicle designed to travel along the trenches at the sides of the strip of land;

c) directing the vehicles supporting the cutting device to move along the trenches so that the cutting device engaging the mineral deposit seam cuts a thin slot of approximately 3 to 6 inches in thickness in the seam in the direction of movement of the vehicles and the mineral deposits from the seam are removed to the sides of the strip of land by the action of the cutting device, the cutting device being operated so that the mineral deposit and the overburden above the thin slot created by the cutting device subside gradually and close the slot after the cutting device has passed a given location;

d) reversing the direction of the vehicles after a desired length of the strip of land is traversed so as to continue the operation of the cutting device in the opposite direction until the cutting device reaches a point near the initial engagement with the strip of land;

e) continuing the operating of the vehicles in a back and forth manner until the mineral deposit seam is substantially removed from the strip of land and only the overburden remains; and f) collecting the removed mineral deposits.

9. A method of mining according to claim 8 wherein the removal of the deposits using said cutting device comprises cutting said slot using a cutting device comprising a continuous loop coal cutting chain saw including paddle elements for assisting in removing the deposits.

10. A method of mining a mineral deposit seam situated beneath an overburden in a ridge formation to which access has previously been provided such that roadways exist at the sides of the ridge formation, said method comprising the steps of:

a) excavating at least two roughly parallel elongate access holes in the ridge formation in the area of the coal sea, at an angle to the previously existing roadways so that a central ridge portion is created between the two access holes which has an exposed mineral deposit seam lying underneath the overburden;

b) positioning at one end of the central ridge portion at a point near the lower end of the mineral deposit seam a continuous loop chain or cable drawn cutting device which extends across the width of the central ridge portion through the access holes in the central ridge to the opposite roadway and which is connected at each end of the central ridge portion to a drawworks apparatus located on the roadways adjacent to the central ridge portion;

c) directing the drawworks apparatus connected to the loop chain or cable drawn cutting device so that the cutting device engaging the mineral deposit seam cuts a thin slot of approximately 3 to 6 inches in thickness in the seam in the direction of the take-up of the drawworks apparatus and the mineral deposits from the seam are removed to the access holes at the sides of the central ridge portion and then to the roadways by the action of the cutting device, the cutting device being operated so that the mineral deposits and the overburden above the thin slot subside gradually and close the slot after the cutting device has passed a given location;

d) reversing the take-up direction of the drawworks apparatus after a desired length of the central ridge portion has been traversed so as to continue the operation of the cutting device in the opposite direction until the cutting device reaches a point near the initial engagement of the central ridge portion;

e) continuing the operation of the drawworks apparatus in a back and forth manner until the mineral deposit seam is substantially removed from the central ridge portion and only the overburden remains; and f) collecting the removed minerals deposits.

11. A method of mining according to claim 10 wherein removal of the deposits using said cutting device comprises cutting said slot using a continuous loop coal cutting chain saw including paddle elements for assisting in removing the deposits.

* * * * *